US012330012B2

(12) United States Patent
Simpson

(10) Patent No.: US 12,330,012 B2
(45) Date of Patent: Jun. 17, 2025

(54) COMBINATION EXERCISE MACHINE

(71) Applicant: Jeffrey Simpson, Saskatoon (CA)

(72) Inventor: Jeffrey Simpson, Saskatoon (CA)

( * ) Notice: Subject to any disclaimer, the term of this patent is extended or adjusted under 35 U.S.C. 154(b) by 13 days.

(21) Appl. No.: 18/005,660

(22) PCT Filed: Jul. 16, 2021

(86) PCT No.: PCT/CA2021/050990

§ 371 (c)(1),
(2) Date: Jan. 16, 2023

(87) PCT Pub. No.: WO2022/011481

PCT Pub. Date: Jan. 20, 2022

(65) Prior Publication Data

US 2023/0285795 A1 Sep. 14, 2023

Related U.S. Application Data

(60) Provisional application No. 63/052,776, filed on Jul. 16, 2020.

(51) Int. Cl.

| | |
|---|---|
| ***A63B 21/078*** | (2006.01) |
| ***A63B 21/00*** | (2006.01) |
| ***A63B 23/04*** | (2006.01) |
| ***A63B 23/12*** | (2006.01) |

(52) U.S. Cl.

CPC ..... *A63B 21/078* (2013.01); *A63B 21/4029* (2015.10); *A63B 23/0405* (2013.01); *A63B 23/1209* (2013.01); *A63B 2023/0411* (2013.01)

(58) Field of Classification Search

CPC . A63B 23/035; A63B 23/03558; A63B 23/04; A63B 23/0405; A63B 23/12; A63B 23/1209; A63B 23/1236; A63B 2023/0411; A63B 21/078; A63B 21/4029; A63B 21/0615

See application file for complete search history.

(56) References Cited

U.S. PATENT DOCUMENTS 4,650,186 A * 3/1987 McCreery ..... A63B 21/4005 482/104
7,717,833 B1 * 5/2010 Nelson ..... A63B 21/15 482/137

(Continued)

FOREIGN PATENT DOCUMENTS

| | | |
|---|---|---|
| CA | 1254243 A | 5/1989 |
| CA | 2630430 C | 4/2015 |
| JP | 2006239395 A | 9/2006 |

OTHER PUBLICATIONS

International Search Report and Written Opinion for corresponding Application No. PCT/CA2021/050990 issued Dec. 23, 2021.

*Primary Examiner* — Gary D Urbiel Goldner
(74) *Attorney, Agent, or Firm* — Renner, Otto, Boisselle & Sklar, LLP

(57) ABSTRACT

A combination exercise machine comprising a chest press lifting assembly and a leg press lifting assembly disposed at opposing ends of a user surface, permitting a user to execute a simultaneous combined leg and chest press movement. Independent left and right side subassemblies to selectively engage one or the other side of the body of the user are also included.

10 Claims, 4 Drawing Sheets

(56) References Cited

U.S. PATENT DOCUMENTS

| | | | | |
|---|---|---|---|---|
| 7,985,167 | B2 * | 7/2011 | Nizam | A63B 21/4043 482/92 |
| 2007/0275833 | A1 * | 11/2007 | Ramsey | A63B 21/0628 482/79 |
| 2008/0039296 | A1 | 2/2008 | Steinmetz | |
| 2008/0227607 | A1 * | 9/2008 | Nizam | A63B 23/03558 482/100 |

* cited by examiner

COMBINATION EXERCISE MACHINE

This application is a national phase of International Application No. PCT/CA2021/050990 filed Jul. 16, 2021, which claims priority to U.S. Application No. 63/052,776 filed Jul. 16, 2020, each of which is hereby incorporated herein by reference in its entirety.

The present invention is in the field of personal fitness equipment, and more specifically comprises an exercise machine that has a leg press component and a chest press component that can be used simultaneously or independently.

BACKGROUND OF THE INVENTION

There are currently limitations in the availability of weight machines in gyms that allows a person to have a challenging leg, core and upper body workout in one exercise, while ensuring that all exercises are done in a way that is safe and ergonomically correct. It is believed that if it were possible to provide a safe weightlifting apparatus that would provide the ability to engage legs, upper body and core muscles of the user at the same time, fitness and personal development outcomes would be maximized.

Another area of weight training in which it is believed that development would be beneficial would be to provide the ability with a combined leg and upper body workout to provide the ability to engage only one half of the body of the user—ie. the left or right leg and arm—at one time, either to vary the workout or provide the ability to modify the training for one or the other side of the user's body which might be weaker. There have not been any weight machines developed which in a controlled and safe way permit for the engagement of the entire body of a user in a combined maximized-core workout for upper and lower body, or would allow for selective use and engagement of only one side (left or right) of the body of the user.

In addition to providing the ability to engage upper and lower body in a maximized core workout, provision of a weightlifting apparatus which would permit simultaneous upper and lower body workout would also permit a faster workout for the user which it also believed would be commercially beneficial.

SUMMARY OF THE INVENTION

The present invention addresses the above noted issues by combining a lower body motion with a upper body motion, where the user must also engage their core to complete the exercise. The present invention provides for an efficient, and challenging workout, as the entire body is engaged. By combining the lower body, upper body and core, a user is able to have a stable, efficient and challenging workout.

Further the present invention also allows a user to isolate lower body exercises from upper body exercises and vice versa, and further allows a user to train either side of the body in isolation, thereby allowing targeted training in the event one side of the body is weaker than the other.

In a first embodiment the invention comprises a combination exercise machine to permit combined upper and lower body workouts of a user. The core of the machine is a user support frame. The user support frame has opposing upper and lower body ends and left and right sides, and defines an upper user surface for supporting the body of the user when the machine is in use. The user support frame includes a surface-engaging support base for engaging the floor surface on which the machine is positioned.

The support base could comprise feet, legs or other floor-engaging elements for supporting the machine at the desired height on the operating floor. Any number of support base configurations will be understood to those skilled in the art that would properly position the machine safely on a floor and at the desired user use height, and all are considered within the scope of the invention.

A chest press sub-frame is located at the upper body end of the user support frame. The chest press sub-frame includes chest press lifting apparatus capable of attachment of adjustable weight to permit adjustable weight chest press by a user positioned on the user surface, and hand grips for the left and right hands of a user. The general concepts of chest press lifting apparatus will be understood to those skilled in the art, along with different methods of manufacture to permit the removeable attachment of weight plates or other weight elements to allow for the adjustment of the weight to be lifted by the user with the apparatus and all such apparatus are contemplated within the scope hereof. Effectively the chest press lifting apparatus will permit a user positioned on the user surface to exercise their upper body with a standard chest press exercise, and the adjustable weight can be set for the user before commencement of use.

At the opposing lower body end of the user support frame a leg press sub-frame is included. The leg press sub-frame includes leg press lifting apparatus capable of attachment of adjustable weight to permit adjustable weight leg press by a user positioned on the user surface, and at least one foot plate to permit the engagement of the feet of the user. As in the case of the chest press lifting apparatus, leg press lifting apparatus will be understood to those skilled in the art and various modifications in terms of the nature of the attachment or adjustment of weight, foot plate or foot rest configuration could again be varied without departing from the scope and intent hereof and all are contemplated within the scope of the present invention.

The user support frame is sized to permit the proper simultaneous engagement of the chest press lifting apparatus and the leg press lifting apparatus by the upper and lower body of the user positioned on the user surface thereof. The user surface might be adjustable in length or orientation to permit the accommodation of users of different types, in some embodiments, and those are also contemplated within the scope of the present invention. Certain embodiments of the machine might have a flat user surface positioned parallel to the floor, and other embodiments could permit for inclined positioning of the user surface so that the user's body would be on a plane angled to the floor during use.

The machine when used permits the user, while positioned on the user surface, to execute a combined chest press and leg press movement with their upper and lower body, using the chest press lifting apparatus and the leg press lifting apparatus at the selected attached adjustable weight for each simultaneously.

In some embodiments of the machine the chest press sub-frame and associated chest press lifting apparatus permit combined chest press lifting movements using both the left and right arms of the user simultaneously. In other embodiments the chest press lifting apparatus comprises left and right chest lifting subassemblies which permit independent chest press lifting movements using the left or right arm of the user singly, or allows for the use of varying adjustable weights on each of the left and right hand sides of the chest press. Both such approaches are contemplated within the scope hereof.

In some embodiments of the machine the leg press sub-frame and associated leg press lifting apparatus permit combined leg press lifting movements using both the left and right legs of the user simultaneously. In other embodiments the leg press lifting apparatus comprises left and right leg lifting subassemblies which permit independent leg press lifting movements using the left or right leg of the user singly, or allows for the use of varying adjustable weights on each of the left and right hand sides of the leg press. Both such approaches are contemplated within the scope hereof.

The user surface could also include a bench pad, to make the surface more comfortable for use.

The various embodiments of the combination exercise machine of the present invention will permit a user to have a maximized workout, fully engaging their upper body, lower body and core at the same time. Variations of the unit can permit selective left and right side workout or independent loading of individual user limbs.

BRIEF DESCRIPTION OF THE DRAWINGS

The following figures illustrate various aspects and preferred and alternative embodiments of the invention.

DESCRIPTION OF THE INVENTION

"Front" refers to the side of the exercise machine of the present which includes the press bench. "Rear" or "back" refer to the side of the exercise machine opposite to the front. The left and right side of the exercise machine of the present invention are determined by viewing the machine from the front side. In the reference numbers "a" denotes an element of the machine that is located on the left side of the exercise machine of the present invention, and "b" denotes an element that is located on the right side of the machine.

Figure 1:
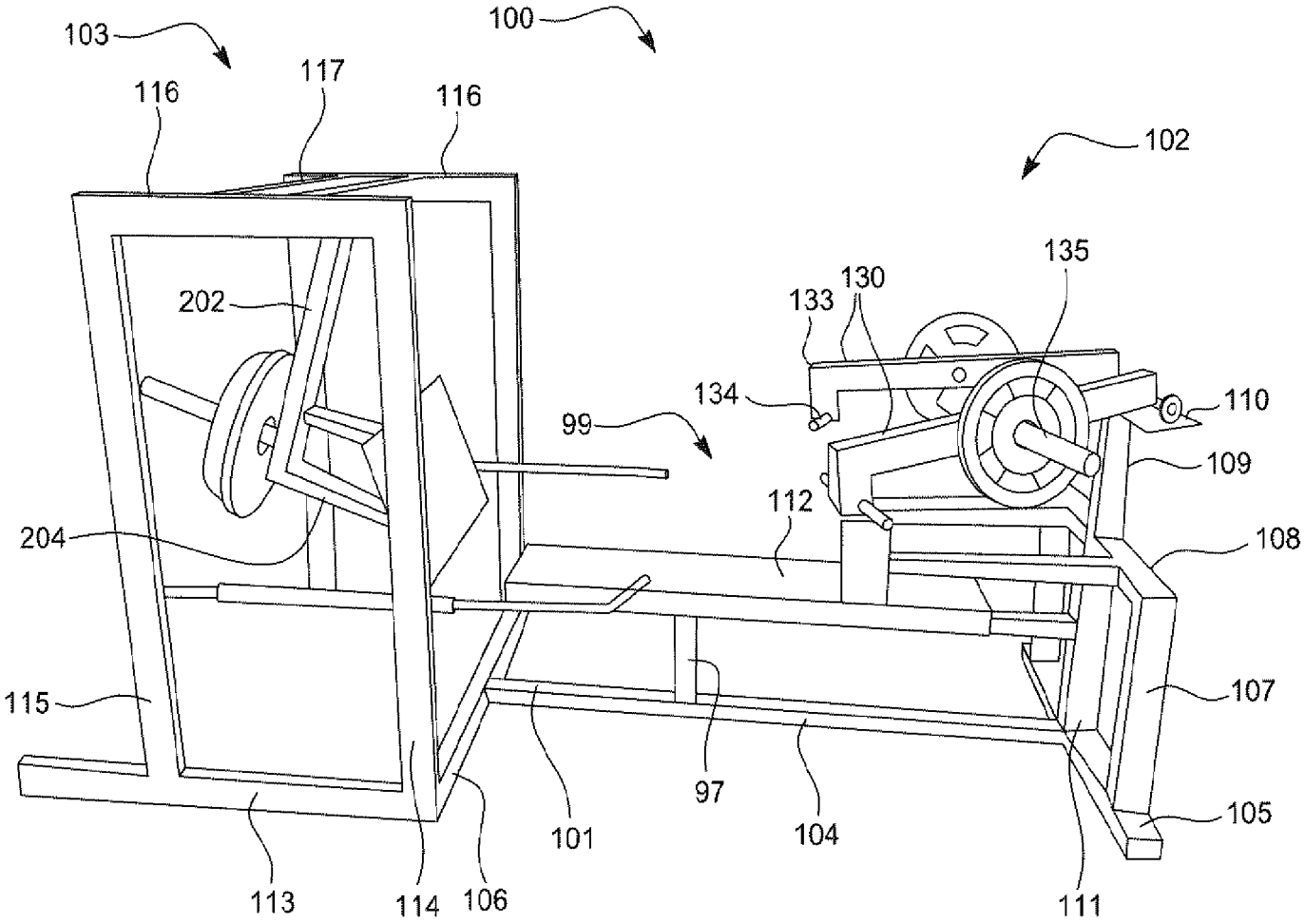
FIG. 1 illustrates a perspective side view of one embodiment of a machine according to the invention.
Figure 2:
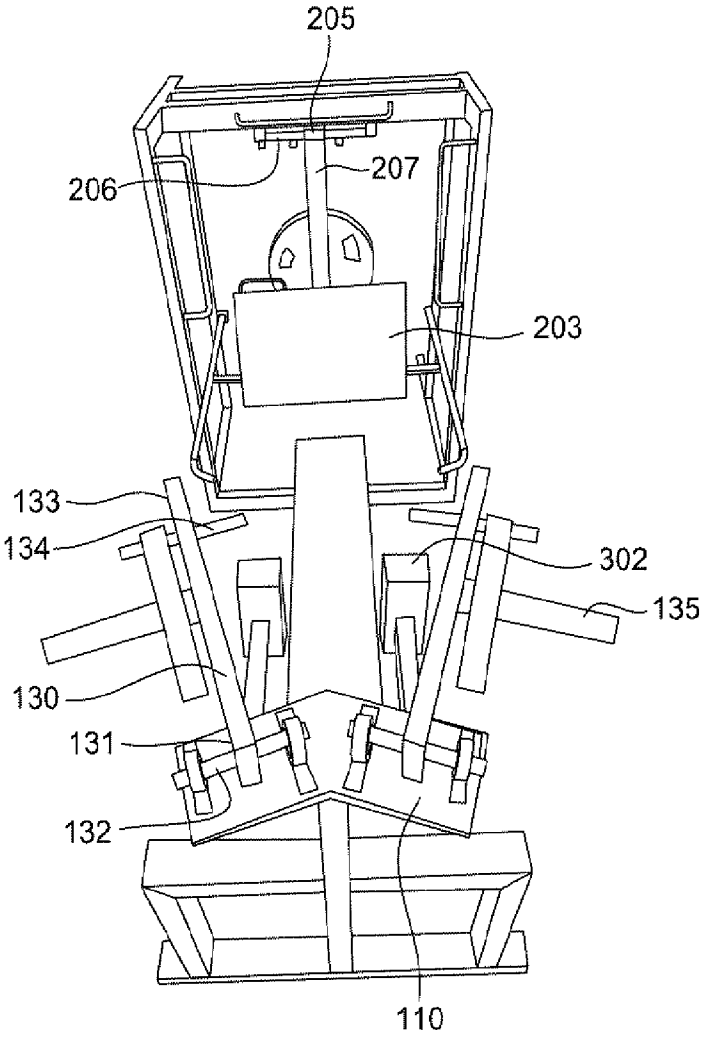
FIG. 2 illustrates an elevated front perspective view of the machine of FIG. 1.
Figure 3:
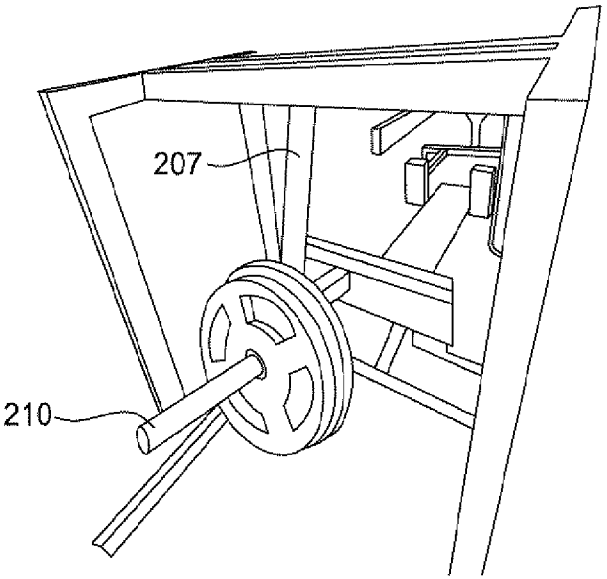
FIG. 3 illustrates a side perspective view of the machine of FIG. 1.

Referring to FIGS. 1 to 3 there is shown an embodiment of the combination exercise machine of the present invention.

A user support frame 99 includes a longitudinal central support member 104 which abuts front bottom transverse member 105 and abuts back bottom transverse member 106. The longitudinal central 104, front 105 and back members 106 engage with the floor.

The user support frame is designed to ensure the simultaneous ergonomic engagement of the chest press lifting apparatus and the leg press lifting apparatus. The frame dimensions are optimized to position the user's shoulders and feet at appropriate distances from the press apparatuses, allowing for smooth and simultaneous execution of upper and lower body exercises. The ergonomic design of the user support frame minimizes strain on joints and ensures proper alignment of the user's body during simultaneous engagement of the chest press and leg press apparatus.

An elevated, longitudinal central member or bench bar 111 serves to support a bench pad 112 for the user. The longitudinal central member 104 is connected to the bench bar 111 that may include a pad 112 for supporting a user.

The figures illustrate a bench pad 112 supporting a user in a supine position, however, the bench may include a mechanism for disposing for supporting a user in an inclined position as well. A vertical member 97 may extend between the central member 104 and the bench bar 111 to provide mechanical support to the bench bar 111.

The exercise machine 100 is supported by a support base 101 that provides stability to the machine 100. The support base 101 shown includes a front or chest press sub-frame 102, which provides stability for the chest press component of machine 100, a rear or leg press sub-frame 103, which provides stability to the leg press component of machine 100, and a middle or user support frame 99. The front, chest press sub-frame 102, seen in FIGS. 1 and 2, includes at least two parallel upright members 107 extending between the front bottom transverse member 105 and a front top transverse member 108. An upright member 109 has a bottom end that is secured to the front top transverse member 108 and a top end that supports a base plate 110. Base plate 110 supports the movable parts of the chest press component.

The rear sub-frame 103 seen in FIGS. 1 and 3 includes the back bottom transverse member 106 and two longitudinal members 113 extending backwardly from each end of the transverse member 106. The back member 106 and the two longitudinal members 113 engage with the floor. Each longitudinal member 113 supports two spaced apart upright members 114 and 115. The upright members 114 and 115 are joined at the bottom by the longitudinal members 113 and at the top by longitudinal members 116. The top longitudinal members 116 are joined by one or more top transverse member 117 which extends from a mid-portion of one longitudinal member 116 to a mid-portion of the other longitudinal member 116. The movable parts of the leg press component are held by the top transverse member 117.

At the upper body end of the user support frame 99 is located a chest press subframe 102 and a chest press lifting assembly. The chest press lifting assembly in the embodiment shown comprises two independent pivotally moveable press arms 130 to which resistance plate holders 135 may be attached, are pivotally attached to a top surface of the base plate 110. Each of the two press arms 130 include a distal or rear end 131 and an opposite forward end 133. Each press arm 130 is independently and pivotally attached to the base plate 110 from its distal or rear end 131 at pivots bars 132. Press arms 130 are provided with horizontal grips 134 at the forward ends 133 of the press arms 130. When not in use, the press arms 130 rest on top of base plate 110. In the embodiment shown, the two press arms 130 can be independently loaded and used by either the left or right arm of the user. In other embodiments a joined chest press subframe would permit the left and right arms of the user to jointly lift a single weight load.

In the embodiment shown the base plate 110 takes a "V" shape, but other configurations will be understood to those skilled in the art and are intended within the scope of the present invention.

The general concepts of chest press lifting apparatus will be understood to those skilled in the art, along with different methods of manufacture to permit the removeable attachment of weight plates or other weight elements to allow for the adjustment of the weight to be lifted by the user with the apparatus and all such apparatus are contemplated within the scope hereof. Effectively the chest press lifting apparatus will permit a user positioned on the user surface to exercise their upper body with a standard chest press exercise, and the adjustable weight can be set for the user before commencement of use.

The chest press lifting apparatus comprises pivotally mounted press arms, each having a distal end configured to engage adjustable weights and a proximal end provided with horizontal hand grips for user engagement. The press arms are pivotally mounted to a base plate at their distal ends, allowing rotational movement during the chest press exercise. The hand grips are ergonomically positioned to align with the user's shoulder width when positioned on the user surface.

The adjustable weights for both the chest press and leg press lifting apparatuses may include plate-loaded mechanisms or other adjustable resistance systems. These weights can be independently adjusted to accommodate varying strength levels for different users or unilateral exercises.

In certain embodiments, the chest press lifting apparatus comprises independent left and right subassemblies. Each subassembly includes a pivotally mounted arm, a hand grip, and a weight engagement mechanism, allowing the user to perform unilateral exercises. Similarly, the leg press lifting apparatus may include independent left and right subassemblies, each having its own "L"-shaped arm, footplate, and weight engagement mechanism, enabling unilateral lower body exercises.

Referring next to the lower body end of the user support frame there is shown a leg press subframe 103 and associated leg press lifting apparatus. The leg press lifting apparatus includes an "L" shaped leg exercise arm 202 having a vertical bar 207 and a horizontal bar 204 joined to form the right angle of the "L". A user foot plate 203 secured to the free end of horizontal bar 204 of the "L" shaped arm 202, and a pivot connection 205 to a pivot bar 206, which pivotally connects the top free end of the vertical bar 207 forming the "L" shaped leg exercise arm 202 to the leg frame of the exercise machine 100. The "L" shaped leg exercise arm 202 may also include resistance plate holders 208. Resistance plate holder 210 for the leg press may be attached to the vertical bar 207. The leg press subframe shown in these Figures shows a single leg press device wherein both legs of the user would lift a single weight load. As outlined elsewhere herein in further embodiments, the leg press subframe could be manufactured with left and right leg subassemblies permitting individual leg loading and exercise.

The leg press lifting apparatus includes an "L"-shaped leg exercise arm comprising a horizontal bar and a vertical bar. The horizontal bar supports a footplate for user engagement, and the vertical bar is configured to engage adjustable weights. The footplate is ergonomically designed to accommodate varying foot sizes and is positioned to ensure proper alignment with the user's legs during the leg press exercise. The vertical bar is pivotally connected to the leg press sub-frame, allowing for smooth movement when the weights are lifted.

Figure 4:
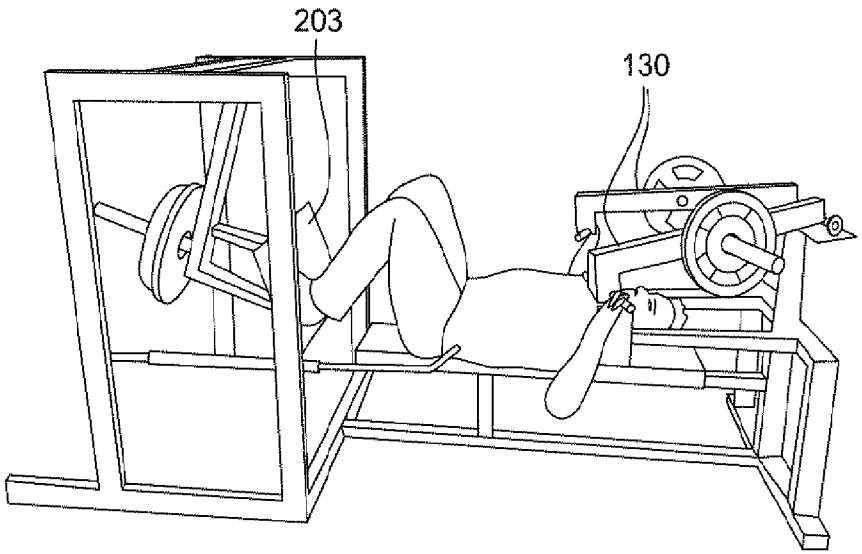
FIG. 4 is a side view of the embodiment of FIG. 1 with a user in the relaxed/non-engaged body position.
Figure 5:
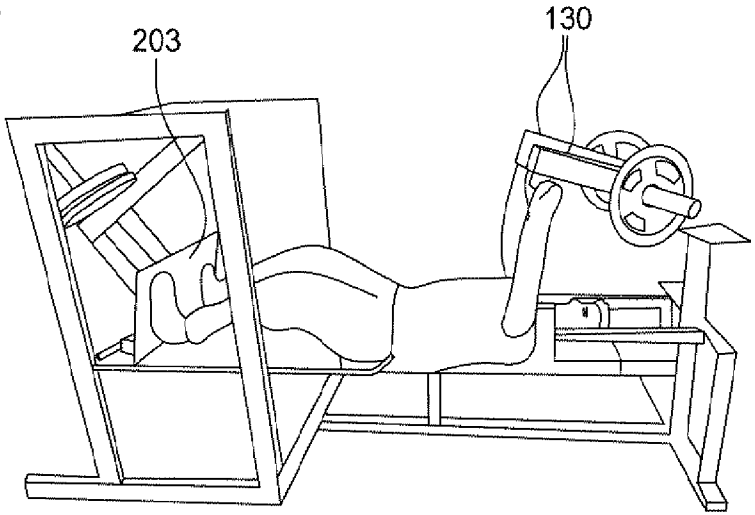
FIG. 5 is a side view of the embodiment of FIG. 4 with the user having engaged and extended their upper and lower bodies on the chest and leg press assemblies.

FIGS. 4 and 5 illustrates a user performing a lying leg press and a chest press exercise simultaneously. The user first lies on the bench with the machine on the start position (FIG. 4), with his/her shoulders braced against shoulder pads 302, the hands grabbing the horizontal grips 134 of the chest press and the feet placed on the foot plate 203 such that the user is in a horizontal squatted positon with the legs bent. The user pushes the foot plate forward (i.e. towards the back of the machine), while simultaneously lifting the press arms 130. Of course, the machine of the present invention may also be used just as a leg press or just as a chest press.

Thus, it should be understood that although the present invention has been specifically disclosed by preferred embodiments and optional features, modification, improvement and variation of the inventions embodied therein herein disclosed may be resorted to by those skilled in the art, and that such modifications, improvements and variations are considered to be within the scope of this invention. The invention has been described broadly and generically herein. Each of the narrower species and subgeneric groupings falling within the generic disclosure also form part of the invention. This includes the generic description of the invention with a proviso or negative limitation removing any subject matter from the genus, regardless of whether or not the excised material is specifically recited herein.

It is to be understood that while the invention has been described in conjunction with the above embodiments, that the foregoing description and examples are intended to illustrate and not limit the scope of the invention. Other aspects, advantages and modifications within the scope of the invention will be apparent to those skilled in the art to which the invention pertains.

What is claimed is:

1. A combination exercise machine to permit combined upper and lower body workouts of a user, said machine comprising:

a. a user support frame having opposing upper and lower body ends and left and right sides, said user support frame defining an upper user surface for supporting a body of the user and a surface-engaging support base for engaging a floor surface thereunder;

b. a chest press sub-frame which will permit the user to perform adjustable weight chest press exercises while positioned on the upper user surface using left and right hands of the user, said chest press sub-frame being attached at the upper body end of the user support frame and comprising a chest press lifting apparatus having pivotally mounted press arms configured to engage a first set of adjustable weights and proximal ends provided as hand grips; and c. a leg press sub-frame which will permit the user to perform adjustable weight leg press exercises while positioned on the upper user surface using feet of the user, said leg press sub-frame being attached at the lower body end of the user support frame and comprising a leg press lifting apparatus configured to engage a second set of adjustable weights, the leg press lifting apparatus comprising at least one "L"-shaped leg exercise arm, each "L"-shaped leg exercise arm formed from a pivotably suspended vertical bar joined to a horizontal bar supporting a footplate;

wherein the user support frame is sized to permit a proper simultaneous engagement of the chest press lifting apparatus and the leg press lifting apparatus by the hands and feet of the user positioned thereon; and wherein the user while positioned on the upper user surface can execute a combined chest press and leg press movement with their hands and feet, using the chest press lifting apparatus and the leg press lifting apparatus at a selected attached adjustable weight for each simultaneously.

2. The combination exercise machine of claim 1 wherein the left and right arms of the user chest press lifting apparatus permits combined chest press lifting movements using both left and right arms of the user simultaneously.

3. The combination exercise machine of claim 1 wherein the chest press lifting apparatus comprises left and right chest lifting subassemblies which permit independent chest press lifting movements using the left or right arm of the user singly.

4. The combination exercise machine of claim 3 wherein a weight of the first set of adjustable weights on each of the left and right chest lifting subassemblies is independently adjustable.

5. The combination exercise machine of claim 1 wherein the leg press lifting apparatus permits combined leg press lifting movements using both left and right legs of the user simultaneously.

6. The combination exercise machine of claim 1 wherein the leg press lifting apparatus comprises left and right leg lifting subassemblies which permit independent leg press lifting movements using the left or right leg of the user singly.

7. The combination exercise machine of claim 6 wherein a weight of the second set of adjustable weights on each of the left and right leg lifting subassemblies is independently adjustable.

8. The combination exercise machine of claim 1 wherein the upper user surface further comprises a bench pad for engaging a back of the user positioned thereon.

9. The combination exercise machine of claim 1 wherein the upper user surface is positioned parallel to the floor surface.

10. The combination exercise machine of claim 1 wherein the upper user surface is adjustable to be positioned on an incline, non-parallel to the floor surface.

* * * * *